United States Patent [19]

Reber

[11] 4,258,710

[45] Mar. 31, 1981

[54] MASK-TYPE RESPIRATOR

[76] Inventor: Fred L. Reber, R.R. #1, Box 115A, Gifford, Ill. 61847

[21] Appl. No.: 934,195

[22] Filed: Aug. 16, 1978

[51] Int. Cl.[3] ..... A62B 7/04

[52] U.S. Cl. ..... 128/204.18

[58] Field of Search ..... 128/139, 146 R, 146.7, 128/146.4, 142.3, 200.27, 204.18, 205.24, 205.25, 206.15, 207.11, 207.12, 204.26, 206.21, 206.28

[56] References Cited

U.S. PATENT DOCUMENTS

| | | | |
|---|---|---|---|
| 1,000,706 | 8/1911 | Barnum | 128/146.7 |
| 2,391,565 | 12/1945 | Grindrod et al. | 128/146.4 |
| 2,858,828 | 11/1958 | Matheson | 128/146.4 |
| 3,288,138 | 11/1966 | Sachs | 128/146.6 X |
| 3,570,808 | 3/1971 | Wrenn | 128/142.4 |
| 4,011,865 | 3/1977 | Morishita | 128/142.3 |

FOREIGN PATENT DOCUMENTS

| | | | |
|---|---|---|---|
| 934625 | 10/1955 | Fed. Rep. of Germany | 128/146.3 |

*Primary Examiner*—Harry N. Haroian
*Attorney, Agent, or Firm*—David V. Munnis

[57] ABSTRACT

Respirator of the mask-type covering the nose and mouth of a wearer to protect him from environments containing air-borne obnoxious particles and gases having a combination of a compressed air inlet regulator on the face of the mask, internal baffling which directs inlet air downwardly past the nose of the wearer, and spaces at the mask's sides in the wearer's cheek area and below his mouth to effect an air flow through and out of the mask in a downward direction with little annoyance to the wearer, to assist in exhausting exhaled breath from the mask, and to form an "air-curtain" at the mask's outlet spaces that prevents entry into the mask of obnoxious particles and gases. The mask is further adapted for quick coupling and uncoupling to and from supply lines of air under pressure and for use with air supply lines of widely varying supply pressures.

5 Claims, 3 Drawing Figures

MASK-TYPE RESPIRATOR

BACKGROUND OF THE INVENTION

Many circumstances exist in which persons are subjected to environments containing air-borne particles and/or gases that to them specifically or to people generally are obnoxious. Certain people, for example, due to their particular physiological condition suffer an adverse effect when subjected to particular naturally occurring gases, e.g. ozone, and dust, e.g. selected pollens and spores of fungi and bacteria. In other circumstances, due to the nature of the particular task and/or materials employed, workers on farms and in factories, mines, the construction industry and the like are required to often perform their occupations in environments containing obnoxious quantities of air-borne dust, other solid particles and/or liquid particles and/or gaseous fumes and vapors which are annoying or detrimental to health.

To attempt to minimize the problems posed by such air-borne materials, various helmets and masks have been proposed previously to be worn about the head or nose, with or without the mouth in the latter, to improve respiration. Such respirators previously proposed, however, have not proven to be totally satisfactory due to one or more drawbacks stemming from being too bulky and cumbersome, interferring with or distorting of the wearer's vision, not providing adequately if at all for exhaustion of the wearer's breath thereby requiring intermittent removal of the respirator with the attendant danger and opportunity for inhalation of obnoxious material, restricted for suitable use to wearers of limited facial shapes and contours, cleanable only with difficulty of screened obnoxious materials, devoid of means for coupling to and uncoupling from an air supply line with suitable speed and ease, devoid of suitable means, if any, for regulating respirator inlet air supply, and/or limited for use with air supply lines of undesirably restricted pressures.

Accordingly, a search has continued in the art for an improved respirator which overcomes and eliminates the above and other drawbacks of prior art respirators.

OBJECTS OF THE PRESENT INVENTION

Accordingly, it is the primary object of the present invention to provide an improved mask-type respirator for protecting wearers from environments containing obnoxious air-borne gases and particles.

Another object of the present invention is to provide a novel mask-type respirator which is compact and non-interferring with the wearer's vision and yet which is highly efficient and versatile in use.

A further object of the present invention is to provide an improved mask-type respirator which efficiently provides a wearer with protection from obnoxious air-borne materials and still advantageously efficiently allows for exhaustion of the wearer's breath.

A further object of the present invention is to provide an improved mask-type respirator which is highly efficient in use and advantageously adapted to be worn by persons having widely varying facial sizes and contours.

Still an additional object of the present invention is to provide an improved mask-type respirator which is adapted to provide for an easily accessible regulation of mask inlet air flow.

Yet a further object of the present invention is to provide an improved mask-type respirator which advantageously may be easily and speedily coupled to and uncoupled from an air supply line.

Still another object of the present invention is to provide an improved mask-type respirator which advantageously is adapted for use with air supply lines of widely varying pressures.

The above and other objects are achieved and are characteristics of the respirator mask of the present invention, which invention broadly described comprises:

(a) an opening in front of said mask, (b) compressed air valve means located in said mask front opening, said valve means having an outlet into the interior of said mask and an exterior inlet for connection to a supply of compressed air, said valve means being adapted to be manually adjusted by the wearer of said mask to thereby vary the flow of air into said mask, (c) compressed air supply means connected to said valve means inlet, (d) a coupler element positioned in said air supply means, adjacent said mask valve means whereby said mask can be uncoupled from said air supply, (e) baffle means located within said mask, intermediate said valve means outlet to said mask interior and the nose of the wearer of said mask, whereby air entering said mask through said valve means is directed downwardly within said mask below the nose of the wearer, (f) outlet means from said mask for exhaled breath of the wearer, said outlet means comprising said mask, in the regions of the cheeks of the wearer below the mouth of the wearer, being shaped to be in spaced relationship with respect to the cheeks of the wearer, to define thereby narrow openings to the atmosphere from the interior of said mask.

DESCRIPTION OF EMBODIMENTS OF THE PRESENT INVENTION

Having been broadly described, the present invention will be more particularly described with reference to the attached drawings of which:

Figure 1:
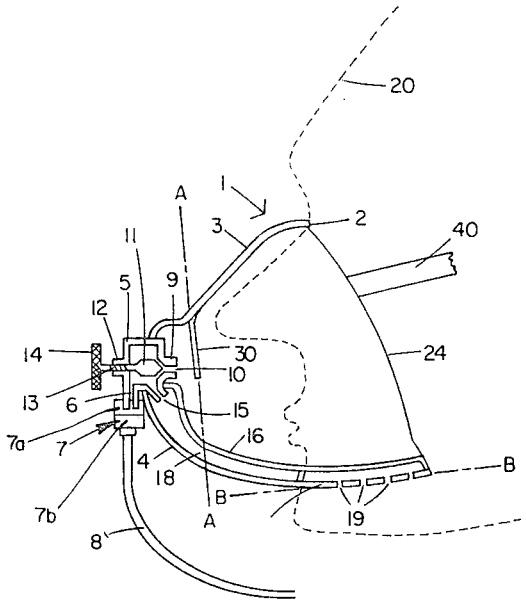
FIG. 1 is a side view, broken away, of an embodiment of the mask respirator of the present invention.
Figure 2:
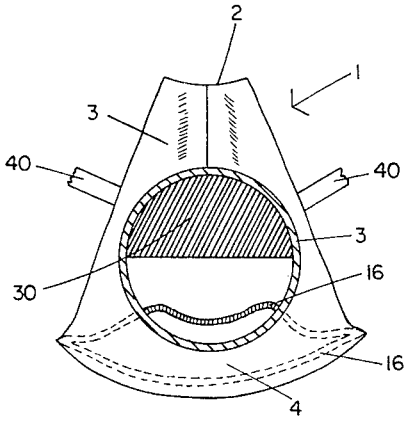
FIG. 2 is a front view, partially broken away, of the mask respirator of the present invention shown in FIG. 1 and taken rearward of Section A—A of FIG. 1.
Figure 3:
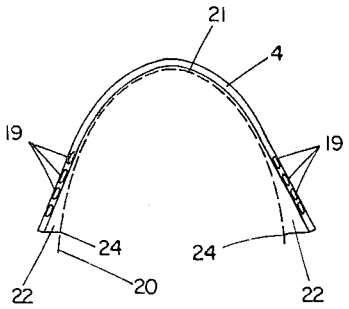
FIG. 3 is a bottom sectional view of the mask respirator of FIG. 1 taken along line B—B.

In the drawing numeral 1 designates generally a head-supported, cup-like mask opened at its rear and shaped to be adapted to engage the face 20 of a wearer to generally ebclosed the nose and mouth of the wearer. Suitable means are provided, such as continuous strap 40 which fits around the head of the wearer, to maintain cup 1 in place to provide an essentially tight fit about the bridge 2 of the wearer's nose, chin 21 of the wearer, and along cheeks 24 of the wearer from bridge 2 to a point below the wearer's mouth where the sides of cup 1 flare slightly outwardly to be in spaced relationship with respect to cheeks 24 of the wearer to define thereby narrow openings 22 from the interior of the mask to the outside atmosphere.

Cup 1 in the front of the mask is provide with an opening 3 in which is located the valve means 5 having an outlet 10 into the interior of mask 1 and an inlet 6 for air under pressure connected via an air supply line couplng means 7 to an air supply line 8, with line 8, in turn, being connected to an air compresser, not shown. Valve means 5 in accordance with the present invention is adapted to be manually adjusted by the wearer of the mask to thereby vary the flow of air into the mask. In the embodiment shown such adjustability is provided by valve 5 having a body element 11 which is adapted to be varied in respect to its position relative to seat 9 by a rotation of stem element 13 by knob 14.

A baffle means 30 is located within cup 1 intermediate outlet 10 of valve 5 and the nose of the wearer of the mask, with baffle means 30 being so shaped and positioned that air entering the mask through outlet 10 is directed downwardly within the mask below the wearer's nose. This feature precludes air entering the mask from directly impinging upon the wearer's nose, which would be irritable to the wearer and further contributes to the advantageous breath exhaust and pressure versatility characteristics of the mask as described hereinafter.

Due to the existence and location of narrow openings 22 below the mouth and in the bottom regions of cheek 24 of the wearer, a main flow of air is autogenously estblished through the mask which follows a path from outlet 10 of valve 5, downwardly around baffle element 30, downwardly past the mouth of the wearer, and downwardly out of cup 1 through openings 22 to the atmosphere. This feature advantageously provides the mask of the present invention with an automatic exhaust of exhaled breath of the wearer and further around outlet openings 22 establishes a pressure differential between air within the interior of the mask and the outside atmosphere which creates a "air curtain" that precludes contaminate-bearing air from the outside atmosphere from entering the mask through openings 22. The magnitude and effectiveness of such an "air curtain" at openings 22 can be adjusted as desired by the wearer by an appropriate manual adjustment of valve 5. The existence of outlet openings 22 further imparts an ability of a particular mask of the present invention to be suitably utilized by a wider range of persons than conventional masks differently designed with respect to mask air flow, since the present mask, in eliminating the need for a flush fit around the lower cheeks of the wearer, is adapted to be used satisfactorily by persons having differing facial contours, particularly in the jaw area where significant differences typically exist. In this respect it should be noted that the maximum width of openings 22 which obtain with respect to a given wearer, however, should not exceed that which, given the available pressure of the air supply, precludes formation of the mask exhaust "air curtain". Accordingly, in preferred embodiments of the mask of the present invention, the maximum width of outlet spaces 22 is less than about 0.25 inch and, more preferably, less than about 0.125 inch.

In preferred embodiments of the mask of the present invention air inlet valve 5 is further provided with a second outlet 15 which communicates with the outside atmosphere whereby excess air supply to valve 5, not passed by valve 5 into the mask, is "bled off". This feature adapts the mask of the present invention to be used with compressed air supply sources having widely varying delivery pressures, including those which exceeded the operation limits of conventional mask respirators. The more preferred embodiments having such a supply "bleed off" capability are further provided with a chamber 18 positioned in the bottom of cup 1, which chamber 18 has an opening communicating with valve bleed outlet 15 and at least one outlet, and preferably a plurality thereof, 19 located adjacent and extending along each of openings 22. This feature allows bleed air from valve 5 to pass through chamber 18 and exit chamber 18 adjacent openings 22 to supplement and reinforce the mask outlet "air curtain".

In accordance with the present invention, coupler element 7 is positioned adjacent, and more preferably directly, to valve means 5. Coupler element 7 suitably may be any conventional coupler element having cooperating male *7a* and female *7b* elements or vice versa used in compressed air line connections wherein the male and female members are joined by cooperating threads, resilient ball and notch arrangements interlocking peg and notch arrangements and the like joined by rotation, semi-rotation, compression and combinations thereof. This feature of locating the mask coupling element to the supply line adjacent the mask advantageously allows ease and speed of coupling and uncoupling of the mask from the air supply line, thus eliminating the need of the wearer to change location to connect or disconnect the mask when its use is desired intermittently.

What is claimed is:

1. In a mask-type respirator including a head-supported, cup-like mask opened at the rear and shaped to be adapted to engage the face and to enclose the nose and mouth of a wearer and having air inlet means whereby air under pressure is introduced into the interior of said mask at a point above the mouth of the wearer, the features comprising:

(a) an opening in the front of said mask, (b) compressed air valve means located in said mask front opening, said valve means having an outlet into the interior of said mask and an exterior inlet for connection to a supply of compressed air, said valve means being adapted to be manually adjusted by the wearer of said mask to thereby vary the flow of air into said mask, (c) compressed air supply means connected to said valve means inlet, (d) a coupler element positioned in said air supply means, adjacent said mask valve means whereby said mask can be uncoupled from said air supply, (e) baffle means located within said mask, intermediate said valve means outlet to said mask interior and the nose of the wearer of said mask, whereby air entering said mask through said valve means is directed downwardly within said mask below the nose of the wearer, (f) outlet means from said mask for exhaled breath of the wearer, said outlet means comprising the sides of said mask, in the regions of the cheeks of the wearer below the mouth of the wearer, being shaped to be in spaced relationship with respect to the cheeks of the wearer, and provides an essentially tight fit about the bridge of the wearer's nose and chin and along the cheeks of the wearer from the bridge of the nose to a point below the wearers mouth where said outlet means is provided whereby said mask sides and the cheeks of the wearer define therebetween narrow openings to the atmosphere from the interior of said mask, whereby a main flow of air autogenously is established through said mask that follows a path downwardly from said air inlet, then downwardly around said baffle means, then downwardly past the mouth of the wearer, and downwardly then out of said mask through said mask outlet means.

2. The mask-type respirator according to claim 1 wherein said coupler element is connected directly to said mask valve means and said coupler element, per se, has cooperating male and female elements.

3. The mask-type respirator according to claim 1 wherein said mask valve means has a second outlet which communicates with the outside atmosphere.

4. The mask-type respirator according to claim 3 wherein said mask is provided with a chamber located in the bottom of said mask, said chamber having an inlet communicating with said valve means second outlet and an outlet communicating with the outside atmosphere adjacent to said narrow openings of said mask outlet means.

5. The mask-type respirator according to claim 4 wherein said coupler element is connected directly to said mask valve means and said coupler element, per se, has cooperating male and female elements.

* * * * *